US005762288A

United States Patent [19]

Neveu et al.

[11] Patent Number: 5,762,288

[45] Date of Patent: Jun. 9, 1998

[54] ANTI-THEFT DISTRIBUTORS FOR ROLL MATERIALS

[75] Inventors: Jean-Louis Neveu, Lery, France; Rudolph W. Schutz, Walnut Creek; George Lipp, San Francisco, both of Calif.

[73] Assignee: Fort James France, Kunheim, France

[21] Appl. No.: 654,546

[22] Filed: May 29, 1996

Related U.S. Application Data

[62] Division of Ser. No. 455,338, May 31, 1995, Pat. No. 5,556,054, which is a division of Ser. No. 215,469, Mar. 21, 1994, Pat. No. 5,445,345, which is a division of Ser. No. 828,295, Jan. 30, 1992, Pat. No. 5,323,980.

[51] Int. Cl.[6] ..... B65H 16/04; B65H 18/04; B65H 75/24

[52] U.S. Cl. ..... 242/597.6; 242/597.3; 242/571.4

[58] Field of Search ..... 242/597.3, 597.6, 242/597.5, 596.7, 571.4

[56] References Cited

U.S. PATENT DOCUMENTS 4,264,042 4/1981 Annoni et al. ..... 242/571.4 X
5,556,054 9/1996 Neveu et al. ..... 242/597.6

*Primary Examiner*—John Q. Nguyen
*Attorney, Agent, or Firm*—Breiner & Breiner

[57] ABSTRACT

An anti-theft dispenser of material wound in a core-free roll. The dispenser includes a substantially planar support and a shaft to support the roll which is perpendicular to the support. The shaft is fitted at its free end with a stop and a compressible anti-extraction element which is axially rotatable on the shaft and is mounted perpendicularly to the support to prevent extraction of the roll in a direction away from the support. The dispenser is characterized in that the compressible anti-extraction element includes a plurality of flexible, compressible anti-extraction rings.

1 Claim, 2 Drawing Sheets

ANTI-THEFT DISTRIBUTORS FOR ROLL MATERIALS

This is as division of application Ser. No. 08/455,388 filed May 31, 1995, U.S. Pat. No. 5,556,054, which, in turn is a division of Ser. No. 08/215,469 filed Mar. 21, 1994, now U.S. Pat. No. 5,445,345; which in turn, is a division of application Ser. No. 07/828,295 filed Jan. 30, 1992, now U.S. Pat. No. 5,323,980.

FIELD OF THE INVENTION

The present invention is directed to an anti-theft dispenser for rolled materials, in particular a dispenser for core-free sanitary paper, paper towels or the like. Further, the present Invention relates to an anti-theft adapter for a dispenser of roll material, in particular for an anti-theft dispenser used with a core-equipped roll of sanitary paper, paper towels or the like.

To simplify the terminology used herein, the invention is described with reference to a roll of sanitary paper. However, no limitation to the invention is to be implied thereby.

BACKGROUND OF THE INVENTION

Particularly in areas which many people utilize, theft of sanitary paper frequently occurs. This causes inconvenience to both the user and supplier. Most of the solutions proposed so far to prevent or lessen this problem nave been ineffective or inconvenient to carry out. Generally, such solutions involve the use of locks. Locks, however, can be forced and hence damaged as well as require keys which can be lost.

U.S. Pat. No. 3,792,822 describes an anti-theft core-equipped support for paper comprising a cylindrical steel spindle on which is mounted a core having several sharp teeth which project and enter the paper-roll core. The total length of the cylindrical steel spindle is at least equal to the length of the paper-roll core. The system disclosed in U.S. Pat. No. 3,792,822, however, has several drawbacks. In particular, the system cannot be practically used with core-free paper rolls. If a core-free paper roll were put in place on such a system, much of the paper roll would tear or else the device could not operate in an anti-theft manner due to excessive play between the cylindrical spindle and the hollow roll part.

On the other hand, core-free rolls are increasingly used, especially for sanitary paper. Such core-free rolls of sanitary paper are advantageously made in the manner described in French Patent No. 2,554,799.

Another problem with systems currently used is that excessive roll unwinding, which results in waste and frequent reloading, occurs. The device described in U.S. Pat. No. 3,792,822 also fails to address the latter drawback.

OBJECTS OF THE INVENTION

A primary object of the present invention is to provide an anti-theft dispenser which is useful with a core-free roll material and can be used in an effective and simple manner.

Another primary object of the present invention is to provide an anti-theft dispenser for roll material which avoids excessive unwinding of the roll material, both as regards to core-equipped rolls and core-free rolls.

Another primary object of the present invention is to provide an anti-theft adapter for a dispenser of roll material which makes it possible to use the dispenser with either core-free paper rolls or core-equipped paper rolls.

Other objects and advantages of the invention are further evident from the description set forth below and the attached drawings.

DESCRIPTION OF THE PRESENTLY PREFERRED EMBODIMENTS

Figure 1:
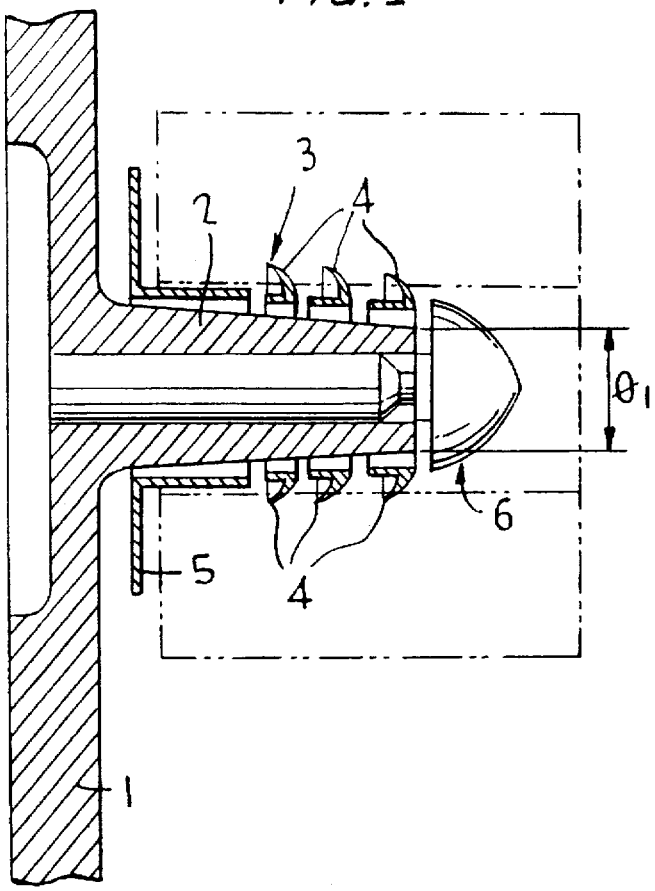
FIG. 1 is a cross sectional schematic view of a first embodiment of the anti-theft dispenser of the present invention for use with core-free paper rolls.
Figure 2:
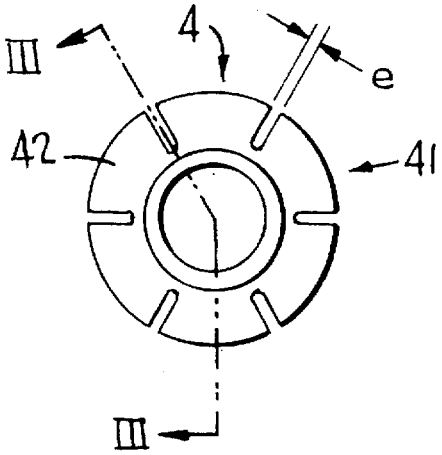
FIG. 2 is a front view of ring 4 as shown in FIG. 1.
Figure 3:
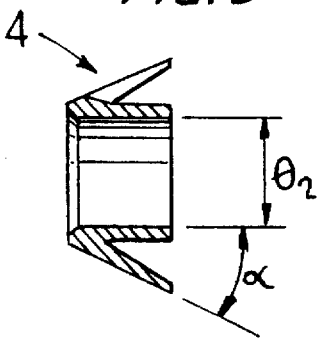
FIG. 3 is a cross sectional view along line III—III of ring 4 as shown in FIG. 2.

The dispenser, according to the present invention, or use with a core-free roll of material, as shown in FIGS. 1, 2 and 3, comprises an essentially planar support 1, a shaft 2 for supporting a roll rigidly joined and perpendicular to support 1, and a compressible anti-extraction means 3 mounted in an axially rotatable manner on shaft 2 perpendicularly to support 1 for preventing withdrawal of the roll in a direction away from support 1. The dispenser is characterized in that the compressible anti-extraction means 3 comprises a plurality of flexible and compressible anti-extraction rings 4. The inside diameter of the anti-extraction rings A is variable. The inside diameter $\phi_2$ of each of the anti-extraction rings 4 is selected so that in combination, if necessary, with any frustoconical shape of shaft 2, the rings will allow for braking of the dispenser in a modulated manner so as to prevent excessive roll unwinding.

The dispenser shown in FIG. 1 also includes a flange 5 which is axially rotatable around shaft 2 and abuts support 1. The flange 5 lacks any anti-extraction means and serves, in particular, to prevent friction between a roll (not shown) which is installed on the dispenser against support 1. Flange 5 can also be used to brake the roll to avoid excessive unwinding. At its free end, the dispenser shown in FIG. 1 includes an essentially ogive-shaped stop 6. Stop 6 is stationary relative to shaft 2 and maintains flange 5 of the anti-extraction rings 4 on shaft 2. Stop 6 is preferably tapered in order to facilitate the placement of a roll on the dispenser.

Preferably, anti-extraction rings 4 are flexible, conical "washers" 41. The ends of washers 41 point toward support 1 and comprise a variable number of spaces therein which define split hook-like members 42.

Illustratively, a compressible anti-extraction ring 4 can comprise six 60° recesses each having a width "e" about 1 mm.

The number or anti-extraction rings 4 utilized on shaft 2 is not critical. The dispenser, as shown in FIG. 1, utilizes three rings 4.

The compressibility of the different anti-extraction rings 4 can vary. Additionally, conical angle "α" can vary.

The anti-extraction means 3 comprising a plurality of compressible rings 4 can evince a "profile" of an essentially cylindrical or frustoconical shape.

In an advantageous embodiment of the invention, the anti-theft device illustrated in FIG. 1 has a total length less than the length of the roll which it is to hold. Preferably, the length of the anti-theft device will equal about half of the rail placed on the device.

The diameter $\phi_1$ of the shaft 2 preferably is about 8 to 11 mm.

Anti-theft dispensers of roll materials of the type shown in FIG. 1 are especially well suited for use with core-free paper rolls since such a R, can be readily slipped onto the shaft 2 over the ogive-shaped stop 6 without tearing and then moves on the flexible anti-extraction rings 4 which are compressed in the direction of roll insertion and thereafter move apart to lock the roll on the dispenser without degrading the rolled material.

In a variation not shown but readily understandable, an anti-extraction ring 4 can be substituted for washer 5.

Figure 4:
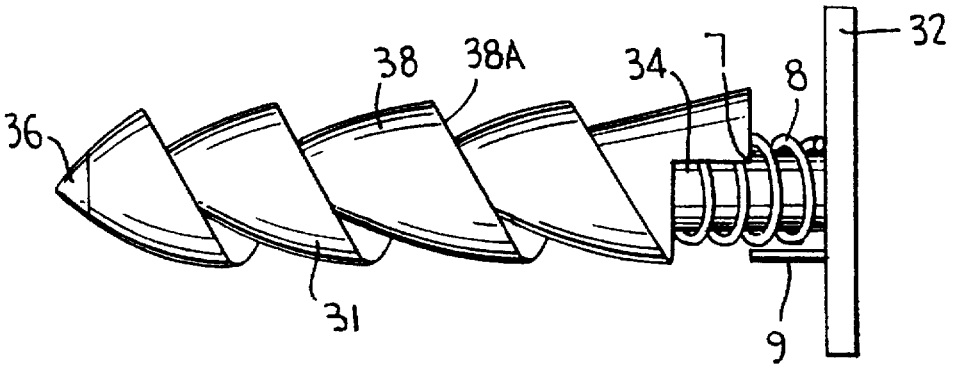
FIG. 4 is a schematic side view of another embodiment of the anti-theft dispenser of the invention for use with core-free pacer rolls.

Another embodiment of the anti-theft dispenser of the present invention is shown in FIG. 4 and comprises an essentially planar support 32 which can be a wall or other base; a shaft 34 to support a roll of material, the shaft being rigidly affixed and perpendicular to support 32 and comprising at its free end a stop 36; a compressible anti-extraction means 38 mounted on shaft 34 perpendicularly to support 32 so as to be axially rotatable on shaft 34 and including compressible anti-extraction means 31 for preventing the withdrawal of a roll in a direction away from support 32. The anti-theft dispenser, as shown in FIG. 4, is characterized in that anti-extraction means 38 comprises a stop 7 at its end facing support 32, shaft 34 is provided with a spring 8 between support 32 and its end facing support 32, and a stud 9 is affixed perpendicularly to support 32 and facing stop 7.

To insert a roll on the dispenser as shown in FIG. 4, the roll is slipped over the anti-extraction means 38 at stop 36 and is screwed clockwise while axially pushing against anti-extraction means 38. Thereupon, anti-extraction means 38 will no longer be able to rotate about itself because of the compression of spring 8 and because stop 7 comes to abut against stud 9. Once in place, the roll cannot be unscrewed because spring 8 is no longer compressed, stud 9 no longer blocks stop 7 and anti-extraction means 38 simply spins or rotates about itself.

In the embodiment shown in FIG. 4, the compressible anti-extraction means 3 assumes the shape of a screw. However, this anti-theft device also can be implemented with the design of FIG. 1. In the latter instance, stud 9 is located on flange 5 or if such flange is not utilized, stud 9 is located on the anti-extraction ring 4 which abuts support 1.

Figure 5:
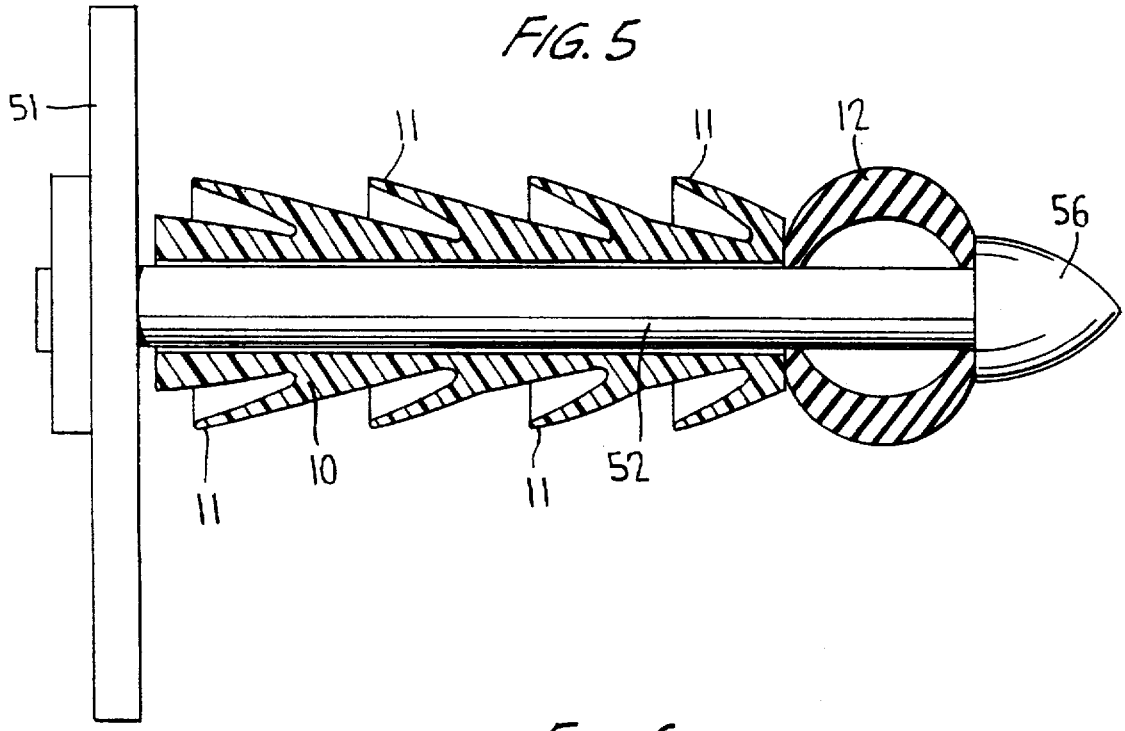
FIG. 5 is a cross sectional schematic view of another embodiment of an anti-theft dispenser of the invention for use with core-free or core-equipped paper rolls.

FIG. 5 shows another embodiment of an anti-theft dispenser comprising a support 51 which can be an essentially planar wall or base, a shaft 52 which is perpendicular to support 51 and serves to support a roll of material, and a first tubular member 10 mounted on shaft 52 in an axially rotatable manner and perpendicularly to support 51. Tubular member 10 comprises compressible anti-extraction means 11 for preventing withdrawal of the roll placed thereon in a direction away from support 51 and includes a stop 56 at its free end. The dispenser is characterized in that it further includes a second flexible tubular member 12 having essentially the shape of a cylindrical ring that is compressively affixed between the stop 56 and the end of the first tubular member 10 facing support 51.

Illustratively, the compressible anti-extraction means 11 is in the shape of hooks, the ends of which point toward support 51.

In another embodiment (not shown), the anti-theft dispenser of roll material, in particular sanitary paper, includes a shaft to receive a roll of material which has hooks as an integral part thereof and has a stop at its free end. Such hooks are as described above in relation to the anti-extraction means. The stop is axially rotatable on the shaft which is perpendicularly affixed to an essentially planar support. The dispenser is also characterized in that the shaft further includes a flexible tubular member essentially having the shape of a cylindrical ring compressively affixed to the stop.

In FIG. 5, the roll (not shown) engages the dispenser over the rounded stop 56 and shaft 52 containing tubular member 10 and compressible anti-extraction means 11. Once the roll is in place, the anti-extraction means 11 prevents the roll from being released from the dispenser until all of the material on the roll has been used up. The flexible tubular member 12 cooperates with the anti-extraction means 11 and additionally ensures braking and locking of the roll in place. In a preferred embodiment of the invention, the total length of the anti-theft roll dispenser is less than that of the roll.

Figure 6:
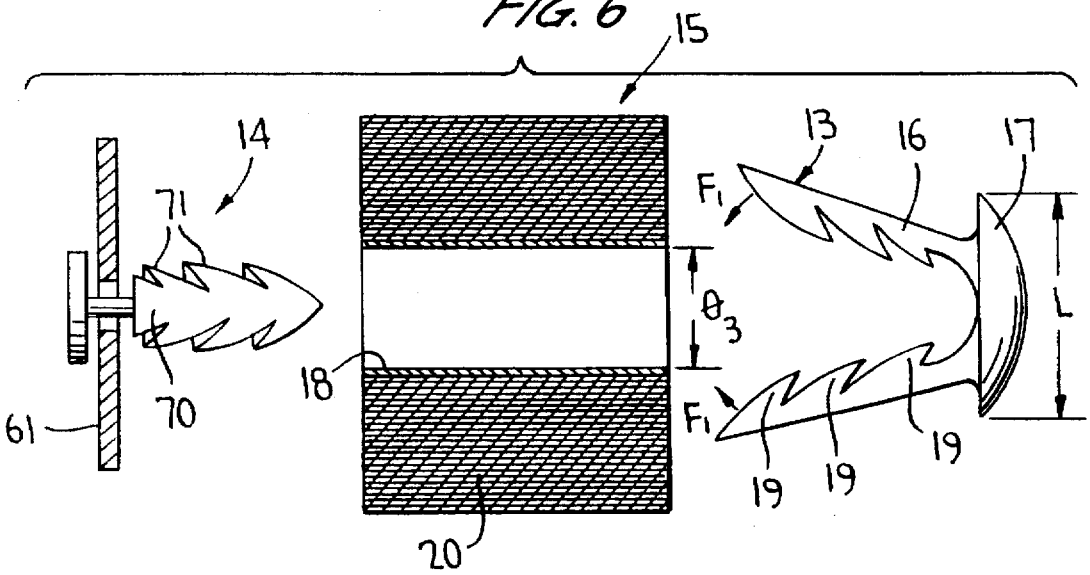
FIG. 6 is a schematic view of an anti-theft adapter of the present invention.

FIG. 6 shows an anti-theft adapter 13 for a dispenser 14 of roll material 15 wherein a hook-containing tubular member 70 is fitted with anti-extraction means 71 comprising jaws 16 linked to a stop 17. The adapter is characterized in that the jaws 16 are flexible and have an interior shape which complements the external shape of tubular member 70 so that jaws 16 will mate with tubular member 70.

In use, the adapter is first inserted into the core 18 of roll 15. The diameter L of stop 17 must be larger than the diameter $\phi_3$ of the core in which it is to be inserted. The flexible jaws 16 are compressed in the direction of arrows $F_1$ so that the jaws fit inside core 18. Thereafter, the jaws expand inside the core 18. The roll 15 with adapter 13 inside its core 18 is then slipped over tubular member 70 of dispenser 14 which is affixed to support 61. The adapter 13 is then locked onto tubular member 70 inside core 18.

The spaces between hooks 19 located inside jaws 16 are such so as to match the shape of the hook-shaped anti-extraction means 71 of tubular member 70. Thereafter, the roll 15 can only be removed from the adapter after paper 20 has been exhausted due to stop 17 blocking the roll. Once paper 20 of roll 15 has been exhausted, the adapter 13 can be removed from core 18 by cutting core 18. Alternatively, a precut core-roll can be used.

The anti-theft adapter of the invention, as evident to one skilled in the art, can also be used with a dispenser such as shown in FIG. 1 and described above.

The present invention makes it possible to use an anti-theft dispenser of a roll material, jointly with an anti-theft adapter, if desired, with either a core-free or core-equipped roll. If desired, braking can also be provided to avert excessive unwinding.

As will be apparent to one skilled in the art, various modifications can be made within the scope of the aforesaid description. Such modifications being within the ability of one skilled in the art form a part of the present invention and are embraced by the appended claims.

It is claimed:

1. Anti-theft dispenser for a roll of material comprising a substantially planar support; a shaft rigidly and perpendicularly affixed to said support at a first end; a first tubular member coaxially rotatably mounted on said shaft and comprising a compressible anti-extraction means for preventing the removal in a direction away from said support of a roll placed on said first tubular member; a means structured to retain said first tubular member on said shaft; and a second tubular member structured substantially in the shape of a flexible cylindrical ring which is compressively held between said means structured to retain said first tubular member and said first tubular member such that said second tubular member is deformable by bulging radially outward.

* * * * *